US005088543A

United States Patent [19]

Bilbrey

[11] Patent Number: 5,088,543

[45] Date of Patent: Feb. 18, 1992

[54] SKYLIGHT SHADE

[76] Inventor: Paul J. Bilbrey, 7021 West Augusta, Glendale, Ariz. 85303

[21] Appl. No.: 533,021

[22] Filed: Jun. 4, 1990

[51] Int. Cl.[5] ..... A47H 1/00

[52] U.S. Cl. ..... 160/310; 160/5; 160/98; 160/239; 160/265; 52/200

[58] Field of Search ..... 160/310, 311, 312, 271, 160/26, 265, 239, 31, 98, 1, 5, 7, 107, 32, 33; 52/72, 200

[56] References Cited

U.S. PATENT DOCUMENTS

| | | | |
|---|---|---|---|
| 2,240,416 | 4/1941 | Pidgeon | 160/98 X |
| 2,754,899 | 7/1956 | Karobonik et al. | 160/310 X |
| 2,780,283 | 2/1957 | Wasserman | 160/271 X |
| 3,294,152 | 12/1966 | Kuijvenhoven | 160/310 X |
| 3,355,149 | 11/1967 | Wiegelmann et al. | 160/310 X |
| 3,646,985 | 3/1972 | Klann | 160/5 X |
| 3,965,348 | 6/1976 | Anetseder et al. | 160/5 X |
| 4,390,054 | 6/1983 | Niibori et al. | 160/265 |
| 4,606,157 | 8/1986 | Esposito | 160/310 X |
| 4,610,116 | 9/1986 | Schulz | 52/72 X |
| 4,691,753 | 9/1987 | Baier | 160/265 X |
| 4,762,160 | 8/1988 | Bechtold et al. | 52/200 X |
| 4,846,242 | 7/1989 | Baier | 160/32 |
| 4,995,442 | 2/1991 | Marzel | 160/5 X |

*Primary Examiner*—David M. Purol

*Attorney, Agent, or Firm*—Don J. Flickinger; Jordan M. Meschkow

[57] ABSTRACT

A shade unit having a frame defining a skylight opening, to which is attached a motor assembly and a shade assembly. A control unit consisting of an open stop switch, a close stop switch controls the motor assembly with a relay switch charging the motors polarity. A wall switch controls the relay switch and a photoelectric switch which can also control the relay switch.

21 Claims, 2 Drawing Sheets

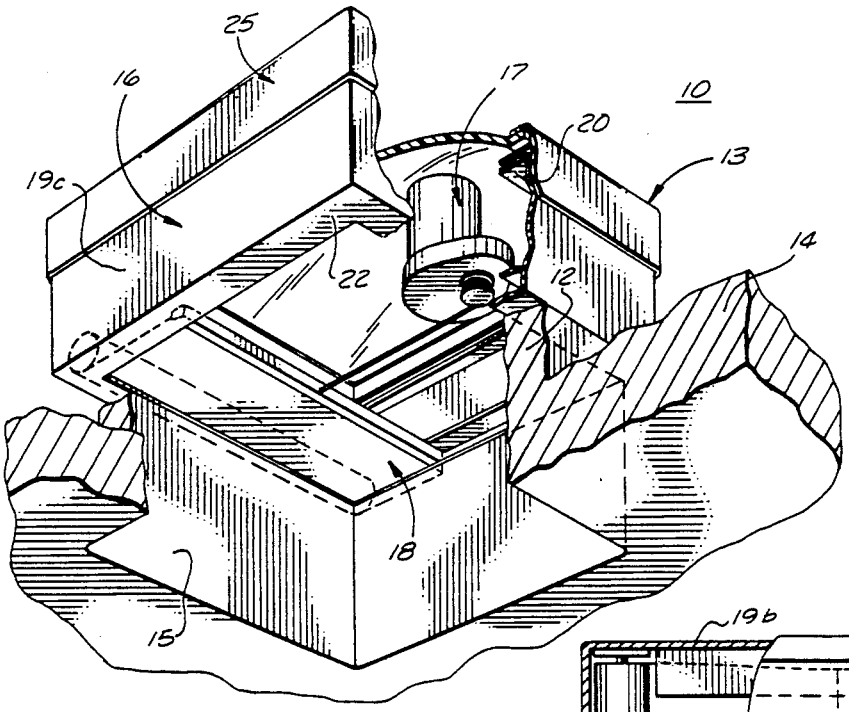
FIG. 1
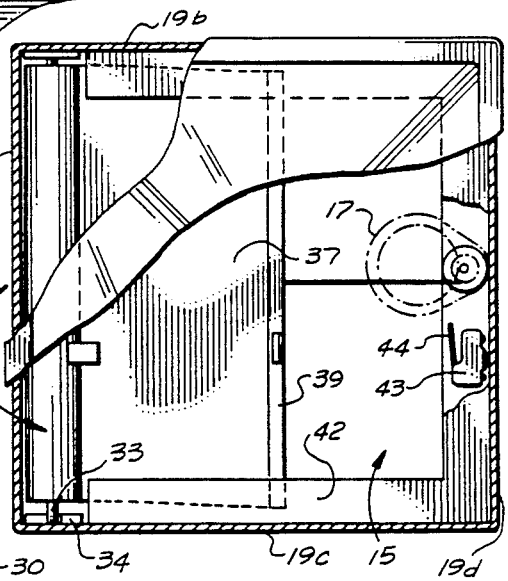
FIG. 2
FIG. 3
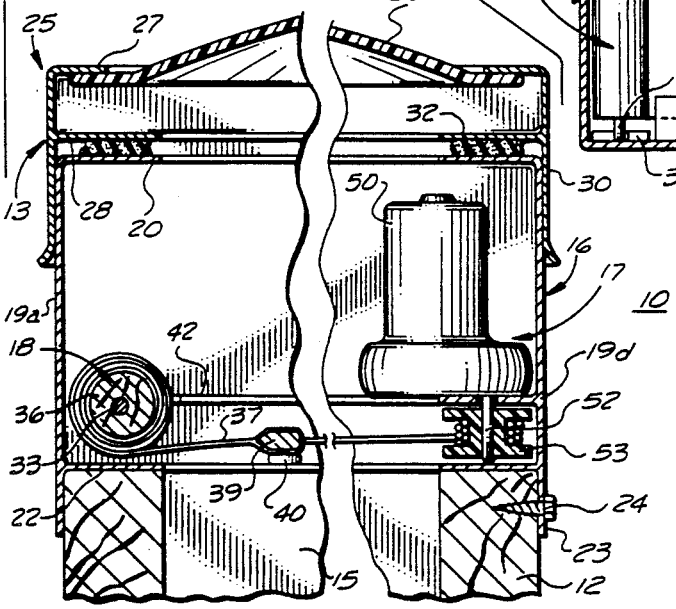

SKYLIGHT SHADE

BACKGROUND OF THE INVENTION

1. Field of the Invention

This invention relates to skylights. More particularly, the present invention relates to a device for closing off light from a skylight.

2. Prior Art

Skylights are a well known and much used device for letting sunlight into a building. In homes, they let in light to dispel gloom and add openness to a room. However, there may be times when a darkened room is desired. A bedroom with a skylight may let in too much light at night. The light might be from a bright moon street light or other sources, and disturb a persons sleep. Also, during cold weather while the ingress of sunlight may help heat the room, the skylight may also cause heat loss due to radiation at night. The same is true during hot weather, in the daytime, allowing sunlight in will increase the temperature in the room. For whatever reason, it may sometimes be desirable for a skylight to be blocked. This can be very difficult, since skylights are usually found in a ceiling and out of reach. Conventional shades would be useless since a ladder would be needed to reach them and a shade does not hang horizontally. A plug of some sort may be used to close the skylight, but this would again necessitate the us of a ladder to reach the skylight and make it very inconvenient.

A typical method of closing a skylight to light, is the use of louvers. These will satisfactorily prevent the entry of light when closed, but will not allow sunlight to enter satisfactorily. If the individual louvers are not angled at the same angle as the sunlight, they will cut off the light. Since the sun is continually moving across the sky, the louvers would have to be continually adjusted; rendering this type of shade impractical.

It would be highly advantageous, therefore, to remedy the foregoing and other deficiencies inherent in the prior art.

Accordingly, it is an object of the present invention to provide a new and improved skylight shade.

Another object of the present invention is to provide an easily installed skylight shade.

And another object of the present invention is to provide an easily accessible skylight shade.

Still another object of the present invention is to provide a skylight shade that may be opened or closed by light intensity.

Yet still another object of the present invention is to provide a skylight shade that prevents substantially all light from entering the skylight.

And yet still another object of the present invention is to provide a skylight shade which helps prevent heat exchange between the outdoors and the indoors.

SUMMARY OF THE INVENTION

Briefly, to achieve the desired objects of the present invention in accordance with a preferred embodiment thereof, provided is a frame to which a motor assembly and a shade assembly are attached. When activated, the motor assembly draws a shade screen across a skylight opening, shutting out light. A lever operated close stop switch is attached to the frame near the motor assembly, which stops the motor when it is tripped A lever operated open stop switch is mounted in the frame near the shade assembly, and stops the motor when the shade screen is fully open and trips the switch. Further provided are relay switches which switch the polarity of the motor each time the shade unit is operated. A photoelectric switch is also provided which can be used to close or open the blinds according to the intensity of the incoming light.

BRIEF DESCRIPTION OF THE DRAWINGS

The foregoing and further and more specific objects and advantages of the present invention will become readily apparent to those skilled in the art from the following detailed description of a preferred embodiment thereof taken in conjunction with the drawings, in which:

FIG. 1 is a cutaway perspective view of a mounted skylight shade constructed in accordance with the teachings of the instant invention, as it would appear with the shade partially closed;

FIG. 2 is a top view of the present invention;

FIG. 3 is a sectional side view of the present invention mounted and having a skylight assembly mounted thereto;

DETAILED DESCRIPTION OF THE PREFERRED EMBODIMENT

Figure 4:
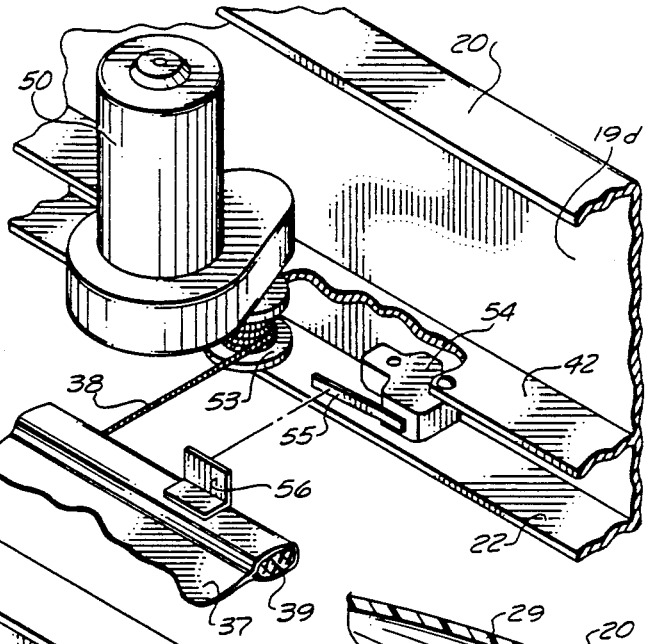
FIG. 4 is a cutaway perspective view of the motor assembly of the present invention.

Turning now to the drawings in which like reference characters indicate corresponding elements throughout the several views, attention is first directed to FIG. 1 which illustrates a shade unit, generally designated 10, mounted onto a curb type skylight mount 12. A skylight unit 13 is then mounted to shade unit 10, which functions as a curb mount in this embodiment. Curb 12 extends upward from a roof 14 and surrounds a skylight opening 15.

Referring to FIG. 3, shade unit 10 consists of a frame 16, a motor assembly 17 and a shade assembly 18. Motor assembly 17 and shade assembly 18 will be discussed more fully below. Frame 16 consists of four walls 19 coupled at right angles to form the walls of a box. A top lip 20 extends perpendicularly inward from the top of walls 19 to substantially the same distance as the thickness of curb 12. A bottom lip 22 extends perpendicularly inward from the bottom of walls 19 corresponding to top lip 20. Because top and bottom lips 20 and 21 respectively, extend inwardly only as far as innermost edge of curb 12, skylight opening 15 extends up through shade unit 10. Bottom lip 22 rests on the top of curb 12 when mounted. Those skilled in the art will understand that an adhesive or other attachment means may be used to secure shade unit 10 to curb 12 using bottom lip 22. However, in this embodiment, a flange 23 extends downward from walls 19 perpendicularly to bottom lip 22. Flange 23 rests flat along the outer surface of curb 12 and is held securely in place by attachments such as screws 24 as illustrated. Thus, bottom lip 22 and flange 23 securely anchor shade unit 10 to curb 12

Still referring to FIG. 3, skylight unit 13 is shown mounted on shade unit 10. Skylight unit 13 is very similar to frame 16. A frame 25 formed by four walls 26 formed at right angles is used. A top lip 27 extends perpendicularly inward from the top of walls 26. A bottom lip 2 extends perpendicularly inward from the bottom of walls 26. Top lip 27 and bottom lip 28 extend inwardly substantially the same distance as top lip 20 and bottom lip 22 of shade unit 10, thus extending skylight opening 15 up through skylight unit 13. A dome 29 is attached to the underside of top lip 17 and extends completely across skylight opening 15 closing it to outside elements while allowing light to enter. A flange 30 extends downward from walls 26 perpendicularly to bottom lip 28. Flange 30 rests flat along the outer surface of walls 1 which serve as a curb mount. A gasket 32 is placed between bottom lip 28 of skylight unit 13 and top lip 20 of shade unit 10 to ensure a tight seal.

Figure 5:
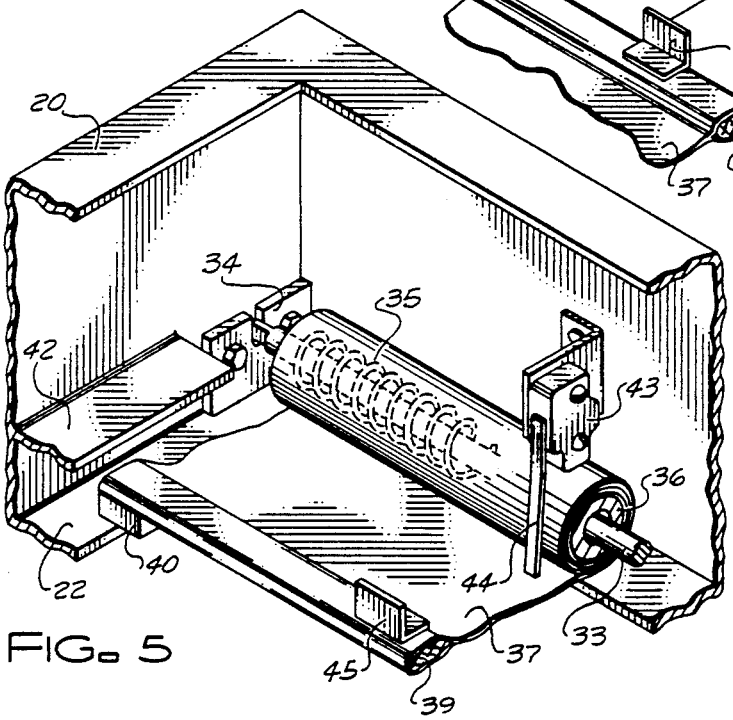
FIG. 5 is a cutaway perspective view of the shade assembly of the present invention.

Turning now to FIG. 5, shade assembly 18 is illustrated. Shade assembly 18 consists of a rod 33 attached to walls **19*b* and 19*c* by brackets 34. Rod 33 is prevented from rotating by brackets 34 and is held parallel to wall 19*a*. As can be seen in FIG. 3, rod 33 is near the middle of bottom lip 22 and therefore shade assembly 18 does not block sunlight opening 15. FIG. 5 shows shade assembly 18 in more detail. A coil spring 35 encircles rod 33 and is attached thereto at one end. A tube shaped roller 36 surrounds coil spring 35 and is attached to the other end thereof. A substantially square shade screen 37 is attached by one end to roller 36. When shade screen 37 is completely rolled up on roller 36, coil spring 35 is at its lowest tension. As shade screen 37 is unrolled, roller 36 increases the tension in coil spring 35 attempts to retract shade screen 37 around roller 36. This is a conventional shade screen known by those skilled in the art. A draw line 38 is attached to the other end of shade screen 37. The end of shad screen 37 has attached thereto a rigid spar 39. This prevents sagging of shade screen 37. A slide 40 is attached to either end of spar 39 on shade screen 37**.

Slide 40 are used to help guide shade screen 37. They slide along bottom lip 22 of frame 16. Open stop switch 43 is coupled to wall **19*a* above shade assembly 18. An open stop switch 43 has a lever 44 extending down in front of shade assembly 18. As shade screen 37 is rolled up, opening skylight opening 15, a tab 45 attached to spar 39 hits lever 44 tripping switch 43**. This will be discussed in greater detail below.

Referring back to FIG. 2, frame 16 of shade unit 10 includes a light seal 42. Light seal 42 extends inwardly form walls **19*b, c, d* to substantially the same distance as top lip 20 and bottom lip 22. Light seal 42 prevents light from entering around shad screen 37 when it is closing skylight opening 15**.

FIG. 4 illustrates motor assembly 17. Motor assembly 17 consists of a reversible gear drive motor 50 attached to light seal 42 on wall **19*d*. In the preferred embodiment motor 50 is attached to light seal 42 equal distance between walls 19*b* and 19*c*. A drive shaft 52 extends down through light seal 42 from motor 50 and is attached to a spool 53. A spool 53 extends down to the level of draw line 38 which is attached thereto. When motor 50 is turning shaft 52 in the closed direction, spool 53 winds up draw line 38, pulling shade screen 37 across skylight opening 15 and winding up coil spring 35. When motor 50 is turning shaft 52 in the open direction, spool 53 unwinds draw line 38, allowing coil spring 35 to relax, tuning roller 36 and wind up shade screen 37. Thus skylight opening 15 is opened to allow sunlight through. A close stop switch 54 is coupled to bottom lip 22 on wall 19*d*. Close stop switch 54 has a lever 55 which extends from close stop switch 54 parallel to wall 19*d*. A tab 56 attached to the upper surface of spar 39 pushes against lever 55 of close sot switch 54, closing it, when spool 53 winds up draw line 38 sufficiently to pull shade screen 37 across skylight opening 15**. This is described in greater detail below.

Figure 7:
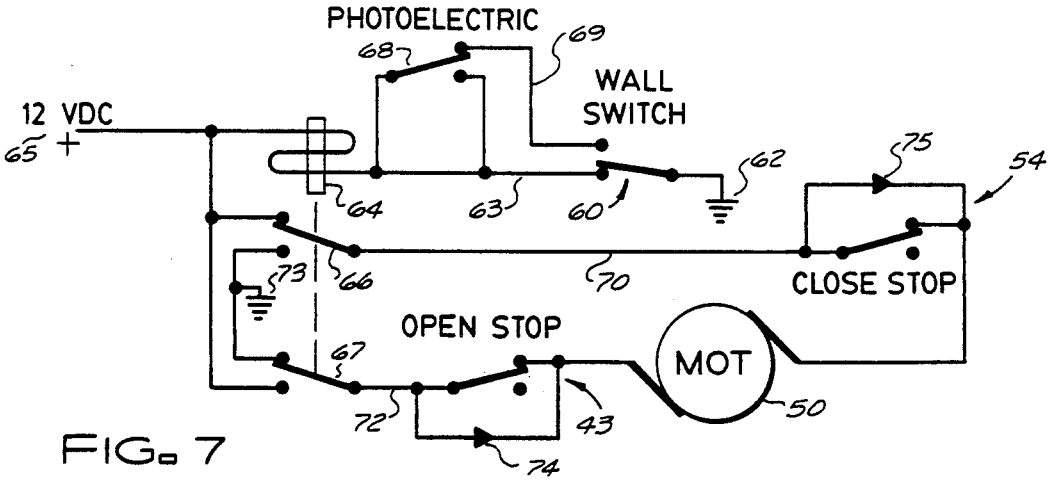
FIG. 7 is a schematic diagram of the control means.

FIG. 7 is a schematic illustrating control means for opening and closing shade screen 37 using reversible gear drive motor 50. Control means for controlling the motor assembly includes a wall switch 60 used to select two positions of operation, automatic or manual. Wall switch 60 is coupled to ground 62. When in manual position wall switch 60 momentarily contacts line 63. Line 63 is coupled to a relay coil 64 of a double pull, double throw relay. When wall switch 60 contacts line 63, a charge from a 12 VDC source 65 passes through relay coil 64 going to ground along line 63. Relay switches 66 and 67 are both thrown when a charge passes through relay coil 64. When wall switch 60 next contacts line 63, switches 66 and 67 will be thrown the other way. When wall switch 60 is switched to automatic, a circuit is completed from ground 62 to a photoelectric switch 68 via line 69. Photoelectric switch 68 completes the circuit to ground 62 depending on changes in light intensity. Its result is identical to the manual position of wall switch 60. Those skilled in the art will recognize a conventional photoelectric switch and its operation. When photoelectric switch momentarily contacts line 69 due to a change in light intensity a charge flows from source 65 through relay coil 64 to ground 62. This throws switches 66 and 67.

When either wall switch 60 or photoelectric switch 68 activates relay coil 64 causing relay switches 66 and 67 to switch, the shade screen 37 is opened or closed. The circuit controlling motor 50 consists of a line 70 coupling relay switch 66 to close stop switch 54. A line 72 couples open stop switch 43 to relay switch 67. Close stop switch 54 is coupled to open stop switch 43 through motor 50. With all switches are left as illustrated, a charge passes to ground 73 through relay switch 66 from source 65 along line 70. The charge passes through close stop switch 54 which is closed, through motor 50, open stop switch 43 and relay switch 67. The motor is thus driven, opening shade screen 37 as discussed above. When tab 45 on spar 39 pushes against lever 44, open stop switch 43 is opened, breaking the circuit to ground. The flow through motor 50 is cut off and motor 50 stops. When shade screen 37 is desired to be closed, wall switch 60 is pushed, momentarily causing a charge to flow through relay coil 64. Switches 66 and 67 are switched to the position opposite the position they are shown in. This reverses the flow of the charge. A charge now passes to ground 73 through relay switch 67 along line 72. While open stop switch 43 is open at this time, the charge passes through a diode 74. The charge flows through motor 50, close stop switch 54, which is closed and to ground through relay switch 66. This flow drives motor 50, closing shade screen 37. As shade screen 37 is closed, tab 45 is removed from against lever 44 thereby allowing open stop switch 43 to close.

When shade screen 37 is fully closed, tab 56 coupled to spar 39 pushes against lever 55, opening close stop switch 54 and breaking the circuit. The flow of charge is stopped and motor 50 is stopped. At this time, close stop switch 54 is open, open stop switch 43 is closed. When next the wall switch is pushed, relay coil 64 throws switches 66 and 67 back to the position shown in FIG. 7. The charge then flows along line 70, and through a diode 75. When tab 56 is removed from lever 55 close stop switch 54 is again closed. The photoelectric switch operator in the same manner as wall switch, 60 except changes in light intensity initiate the sequence.

Figure 6:
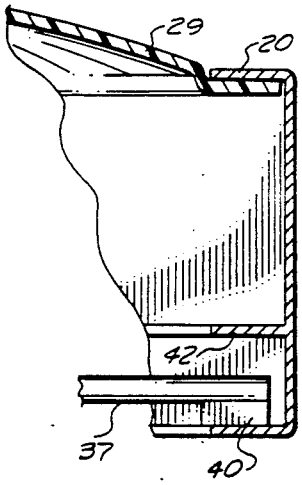
FIG. 6 is a partial side view of the present invention illustrating an alternate dome attachment.

Referring to FIG. 6 a single shade unit 10 can be prefabricated. Instead of installing a shade unit 10 then installing a skylight onto it, a single unit may be constructed. FIG. 6 illustrates a shade unit 10 which is substantially identical to that which is described above, however, instead of installing a curb type dome installation onto frame 16, a dome 29 is built in. Dome 29 is a conventional skylight dome with a flange around its periphery which is attached to the inside of top lip 20 of frame 25. This would simplify the installation of shade unit 10 since a skylight unit 13 would need to be installed separately.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A shade unit for operation with a skylight, comprising:

a) a frame defining a skylight and including
  i) a first end wall,
  ii) a second end wall opposite said first end wall,
  iii) a first side wall extending between said first and second end walls,
  iv) a second side wall opposite said first side wall,
  v) a bottom lip extending inwardly from the bottom of each of said walls, and
  vi) a top lip extending inwardly from the top of each of said walls;

b) a shade assembly attached to the inner surface of said frame proximate said first end wall, said shade assembly including
  i) a rod having a first end mounted in said first side wall and a second end mounted in said second side wall,
  ii) a generally tubular roller movably enclosing said rod, and
  iii) a shade screen having a first end fixedly secured to said roller;

c) a motor assembly attached to the inner surface of said second end wall, said motor assembly including
  i) a reversible gear drive motor,
  ii) a drive shaft extending from a said motor, and
  iii) a spool mounted on said shaft;

d) a draw line having a first end secured to a second end of said shade screen at a location between aid first and second ends of said rod, and a second end secured to said spool;

e) control means for turning said motor assembly on and off and reversing its polarity, and f) attachment means for attaching said frame to a roof.

2. A device as claimed in claim 1 wherein said control means further comprises:

an open stop switch coupled to said frame near said shade assembly;

a close stop switch coupled to said frame near said motor assembly;

said close stop switch and said open stop switch are each electrically coupled to said motor assembly;

a relay switch coupled to said open stop switch and said close stop switch to change the polarity of said motor assemblies.

3. A device as claimed in claim 2 wherein said relay switch is coupled to and controlled by a wall switch.

4. A device as claimed in claim 2 wherein said relay switch is coupled to and controlled by a photoelectric switch.

5. A shade unit according to claim 1, wherein said control means includes means for turning off said motor when said shade screen is fully opened, said means comprising a) an open stop switch coupled to said frame near said first end wall, b) a lever extending from said switch and disposed for movement from
  i) a first position for closing said switch and energizing said motor, to
  ii) a second position for opening said switch and turning off said motor, and c) a tab secured to said second end of said shade screen and positioned to contact and move said lever into said second position when said shade is completely coiled about said roller.

6. A shade unit according to claim 1, wherein said control means includes means for turning off said motor when said shade screen is fully closed, said means comprising a) a close stop switch coupled to said frame near said second end wall, b) a lever extending from said switch and disposed for movement from
  i) a first position for closing said switch and energizing said motor, to
  ii) a second position for opening said switch and turning off said motor, and c) a tab secured to said second end of said shade screen and positioned to contact and move said lever into said second position when said second end of said shade reaches said second end wall.

7. A shade unit for use with a skylight assembly of the type including:

a skylight opening formed in a roof, a curb extending upwardly from said roof and surrounding said skylight opening, a frame including a top lip and a depending flange for mounting said frame to said curb, and a transparent dome carried by said top lip of said frame and extending across said skylight opening, said shade unit comprising:

a) a housing for placement between said curb and sad frame;

b) a shade assembly attached to the inner surface of said housing proximate a first end thereof;

c) a motor assembly attached to the inner surface of said housing proximate a second end opposite said first end;

d) a draw line coupled to said shade assembly and said motor assembly;

e) control means for turning said motor assembly on and off and reversing its polarity; and f) attachment means for attaching said housing to said curb.

8. A shade unit according to claim 7, wherein said housing comprises:
a) at least one side wall;
b) a bottom lip extending inwardly from a bottom portion of said side wall; and
c) a top lip extending inwardly from a top portion said side wall.

9. A shade unit according to claim 8, wherein said attachment means comprises a flange depending from said bottom lip for tightly surrounding said curb.

10. A shade unit according to claim 7, further comprising seal means for placement between said housing and said frame to ensure a tight seal therebetween.

11. A shade unit according to claim 7, wherein said motor assembly comprises:
a) a reversible gear drive motor;
b) a drive shaft extending from said motor; and
c) a spool mounted on said shaft.

12. A shade unit according to claim 11, wherein:
a) said shade unit includes
i) a rod having a first end mounted in one side of said housing and a second end mounted in an opposite side of said housing,
ii) a generally tubular roller movably enclosing said rod, and
iii) a shade screen having a first end fixedly secured to said roller; and
b) said draw line includes a first end secured to a second end of said shade screen at a location between said first and second ends of said rod, and a second end secured to said spool.

13. A shade unit according to claim 7, wherein said control means includes mean for turning off said motor when said shade screen is fully opened, said means comprising
a) an open stop switch coupled to said housing near said first end;
b) a lever extending from said switch and disposed for movement from
i) a first position for closing said switch and energizing said motor, to
ii) a second position for opening said switch and turning off said motor; and
c) a tab secured to said second end of said shade screen and positioned to contact and move said lever into said second position when said shade is completely coiled about said roller.

14. A shade unit according to claim 7, wherein said control means includes means for turning off said motor when said shade screen is fully closed, said means comprising
a) a close stop switch coupled to said housing near said second end;
b) a lever extending from said switch and disposed for movement from
i) a first position for closing said switch and energizing said motor, to
ii) a second position for opening said switch and turning off said motor; and
c) a tab secured to said second end of said shade screen and positioned to contact and move said lever into said second position when said second end of said shade reaches said second end.

15. A skylight assembly comprising:
a) a skylight opening formed in a roof,
b) a curb extending upwardly from said opening and surrounding said skylight opening,
c) a frame including
i) at least one side wall,
ii) a bottom lip extending inwardly from a bottom portion of said side wall,
iii) a top lip extending inwardly from a top portion said side wall, and
iv) a first flange depending from said bottom lip;
d) a housing having an upper portion received within said first flange, said housing including
i) at least one side wall aligned with said side wall of said frame,
ii) a bottom lip extending inwardly from a bottom portion of said side wall,
iii) a top lip extending inwardly from a top portion of said side wall and generally parallel to said bottom lip of said frame, and p2 iv) a second flange depending from said bottom lip of said housing for closely surrounding said curb;
e) a shade assembly attached to the inner surface of said housing proximate a first end thereof;
f) a motor assembly attached to the inner surface of said housing proximate a second end opposite said first end;
g) a draw lien coupled to said shade assembly and said motor assembly; and
h) control means for turning said motor assembly on and off and reversing its polarity.

16. A skylight assembly according to claim 15, wherein:
a) said frame comprises
i) a first end wall,
ii) a second end wall opposite said first end wall,
iii) a first side wall extending between said first and second end walls, and
iv) a second side wall opposite said first side wall; an
b) said housing comprises
i) a first end wall aligned with said first end wall of said frame,
ii) a second end wall opposite said first end wall and aligned with said second end wall of said frame,
iii) a first side wall extending between said first and second end walls and aligned with said first side wall of said frame, and
iv) a second side wall opposite said first side wall, and aligned with said second side wall of said frame.

17. A skylight assembly according to claim 15, further comprising seal means carried between said bottom lip of said frame and said top lip of said housing for ensuring a tight seal therebetween.

18. A skylight assembly according to claim 16, wherein said motor assembly comprises:
a) a reversible gear drive motor attached to the inner surface of said second end wall of said housing;
b) a drive shaft extending from said motor; and
c) a spool mounted on said shaft.

19. A skylight assembly according to claim 18, wherein,
a) said shade assembly comprises:
i) a rod having a first end mounted in said first side wall of said housing and a second end mounted in said second side wall of said housing,
ii) a generally tubular roller movably enclosing said rod, and
iii) a shade screen having a first end fixedly secured to said roller; and b) said draw line includes a first end secured to a second end of said shade screen at a location between said first and second ends of said rod, and a second end secured to said spool.

20. A shade unit according to claim 16, wherein said control means includes means for turning off said motor when said shade screen is fully opened, said means comprising a) an open stop switch coupled to said housing near said first end wall of said housing;

b) a lever extending from said switch and disposed for movement from i) a first position for closing said switch and energizing said motor, to ii) a second position for opening said switch and turning off said motor; and c) a tab secured to said second end of said shade screen and positioned to contact and move said lever into said second position when said shade is completely coiled about said roller.

21. A shade unit according to claim 16, wherein said control means includes means for turning off said motor when said shade screen is fully closed, said means comprising a) a close stop switch coupled to said housing near said second end wall of said housing;

b) a lever extending from said switch and disposed for movement from i) a first position for closing said switch and energizing said motor, to ii) a second position for opening said switch and turning of said motor; and c) a tab secured to said second end of said shade screen and positioned to contact and move said lever into said second position when said second end of said shade reaches said second end wall of said housing.

* * * * *

UNITED STATES PATENT AND TRADEMARK OFFICE

CERTIFICATE OF CORRECTION

PATENT NO. : 5,088,543

DATED : February 18, 1992

INVENTOR(S) : Paul J. Bilbrey

It is certified that error appears in the above-identified patent and that said Letters Patent is hereby corrected as shown below:

Column 5, line 55 delete "a" after "from".
Column 5, line 58 delete "aid" and insert --said--.
Column 6, line 56 delete "sad" and insert --said--.
Column 7, line 33 change "mean" to --means--.
Column 8, line 15 delete "p2".
Column 8, line 23 change "lien" to --line--.

Signed and Sealed this

Fourth Day of May, 1993

*Attest:*

Michael K. Kirk

MICHAEL K. KIRK

*Attesting Officer*

*Acting Commissioner of Patents and Trademarks*